US007429196B2

(12) United States Patent
Takei et al.

(10) Patent No.: US 7,429,196 B2
(45) Date of Patent: Sep. 30, 2008

(54) CARD CONNECTOR

(75) Inventors: Kazunori Takei, Tokyo (JP); Shoichi Hamano, Tokyo (JP); Hitoshi Kikuchi, Tokyo (JP); Hirokazu Takahashi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/265,056

(22) Filed: Nov. 1, 2005

(65) Prior Publication Data

US 2006/0099856 A1 May 11, 2006

(30) Foreign Application Priority Data

Nov. 5, 2004 (JP) ..... 2004-321645

(51) Int. Cl.
*H01R 24/00* (2006.01)

(52) U.S. Cl. ..... 439/630; 439/541.5

(58) Field of Classification Search ..... 439/360, 439/541.5, 862, 79, 326–329, 630, 217–218
See application file for complete search history.

(56) References Cited

U.S. PATENT DOCUMENTS 6,176,737 B1 * 1/2001 Choy ..... 439/541.5
2002/0098740 A1 * 7/2002 Ooya ..... 439/630
2005/0176304 A1 * 8/2005 Yiu ..... 439/630

FOREIGN PATENT DOCUMENTS

JP 2003-031861 1/2003
JP 2005-340141 8/2005

* cited by examiner

*Primary Examiner*—Felix O. Figueroa
(74) *Attorney, Agent, or Firm*—Abelman, Frayne & Schwab

(57) ABSTRACT

A card connector into and from which a plurality of cards are inserted and removed, includes a required number of contacts, and a housing arranging and holding the contacts and having one or plural fitting openings each into which the card is inserted. The contacts each includes contact portions to contact at least two cards so that the same contact can be brought into contact with at least two cards. The card connector has a high degree of freedom for design of substrate and connector without complicating the arrangement of connection portions of contacts and is easy to assemble and easy to mount connection portions onto a substrate by a customer or consumer.

15 Claims, 3 Drawing Sheets

CARD CONNECTOR

FIELD OF THE INVENTION

This invention relates to a card connector for use in electric and electronic appliances in instruments and for use in printers and card readers, and more particularly to a card connector adapted to accommodate a plurality of cards by means of the same contacts.

BACKGROUND OF THE INVENTION

There have been many different kinds of cards as media for a wide variety of information. It has been a common practice to acquire or store various information from or onto a card inserted into a card connector connected to an information appliance.

In prior art card connectors, contacts are arranged correspondingly to cards which are able to be inserted into the card connector, respectively, in one-to-one relationship, and the contacts each at least comprise a contact portion adapted to contact the card, a holding portion held in a housing, and a connection portion to be connected to a substrate. Such card connectors are disclosed in the following Patent Literature 1 (Japanese Patent Application Opened No. 2003-31,861) and Patent Literature 2 (Japanese Patent Application No. 2004-161,293).

Patent Literature 1

According to the Abstract of the Japanese Patent Application Opened No. 2003-31,861, this invention has an object to provide a card connector for integrated circuit (IC) cards having a push-in and push-out mechanism common to plural kinds of cards to achieve the miniaturization in overall shape of the connector. In a card connector for IC cards including a housing having an inserting opening common to plural kinds of IC cards, into which an IC card is inserted to bring the electrode of the IC card into connection with the contacts in the inserting opening, the housing includes therein a slider adapted to advance or retract in conjunction with push-in and push-out operations of the IC card in the housing, and a locking mechanism for locking the slider and the IC card when the push-in is effected and for releasing the locking when the push-out is effected, whereby a shape and a position are set in the slider depending upon the width, length and front shape of the IC card, positions of electrodes of the IC card, and positions of the contacts relative to the housing, thereby enabling the slider to engage the IC card in compliance with shapes of the plural kinds of IC cards. FIGS. 1 and 2 of the Patent Literature 1 illustrate contacts each corresponding to respective card in one-to-one relationship.

Patent Literature 2

According to the Abstract of the Japanese Patent Application No. 2004-161,293 filed by the applicant of the present case, the invention has an object to provide a card connector which, after one card has been inserted, is capable of preventing a further card from being inserted and easy to design its housing and easy to remove a card and achieves its miniaturization without any limitation in circuit design of substrates and without any obstruction to the high density of conductors. In a card connector including a required number of contacts adapted to contact connection portions of a plurality of memory cards and a housing having a plurality of inserting openings for receiving a plurality of memory cards, respectively, and arranging and holding the contacts therein, the card connector comprises at least one locking member located at a predetermined position on the housing and pivotable or movable when one kind of card is inserted, and at least one spring member displaceable when one kind of card is inserted, thereby permitting only one kind of card to be inserted with the aid of the locking member and the spring member. FIGS. 1, 2 and 3 of the Patent Literature 2 show contacts each correspond to respective card in one-to-one relationship.

In recent years, miniaturizations have proceeded in the information appliances as well as substrates or boards used therein so that areas occupied by the substrates have become narrower. Such a limitation of areas occupied by the substrates leads to the use of a plurality of substrates. Moreover, if a plurality of connectors is required for exchanging a plurality of memory cards, information appliances would become bulky which would be inconvenient for carrying them. Consequently, card connectors for receiving a plurality of cards have been proposed as in the Patent Literatures 1 and 2.

The card connectors disclosed in the Patent Literatures 1 and 2 suffer several disadvantages from plural kinds of contacts necessarily required correspondingly to a plurality of cards to be inserted, complicated arrangement of connection portions of the contacts, and difficulties in assembling operationality and mounting operation by a customer. Moreover, as the plural kinds of contacts are required corresponding to the number of cards, areas occupied by the substrates will increase, resulting in limitation of freedom for design of the substrate and connector.

SUMMARY OF THE INVENTION

It is an object of the invention to provide a card connector which overcomes the disadvantages of the prior art described above and which has a high degree of freedom for design of substrate and connector without complicating the arrangement of connection portions of contacts and is easy to assemble and easy to mount connection portions onto a substrate by a customer or consumer.

The above object can be achieved by a card connector 10 into and from which a plurality of cards are inserted and removed, including a required number of contacts 14 each having a contact portion adapted to contact the card, and a housing 12 arranging and holding the contacts 14 and having one or plural fitting openings each into which the card is inserted, wherein according to the invention the contacts 14 each comprise contact portions 22 and 24 to contact at least two cards 50 and 60 so that the same contact 14 can be brought into contact with at least two cards 50 and 60.

In the case that two cards 50 and 60 are inserted into upper and lower fitting openings arranged one above the other, the above object can be achieved by a card connector 10 into and from which two cards 50 and 60 are inserted and removed one above the other, including a required number of contacts 14 each having a contact portion adapted to contact the card 50, 60, and a housing 12 arranging and holding the contacts 14 and having two fitting openings 26 and 28 into which the cards 50 and 60 are inserted, respectively, wherein according to the invention the contacts 14 each comprise contact portions 22 and 24 to contact the two cards 50 and 60, respectively, so that the same contact 14 can be brought into contact with the two cards 50 and 60.

The housing 12 includes an upper wall 30, a lower wall 32, two side walls 34 for connecting the upper and lower walls 30 and 32, and a rear wall 36, and these upper 30, lower 32, two side 34 and rear 36 walls form the one or plural fitting openings 26 and 28, and the two side walls 34 are each provided at the inside with guide means 38 for guiding the card to the contact portions 22 and 24 of the contacts when the card 50, 60 is inserted.

The contacts 14 each comprise a connection portion 16 at one end adapted to be connected to a substrate or the like, a holding portion 18 provided contiguously to the connection portion 16 for fixing the contact to the housing 12, and contact pieces 20 at the other end, which are formed by dividing the portion adjacent to and extending from the holding portion 18 toward the other end into a plurality of pieces each having a contact portion 22, 24 adapted to contact the corresponding card.

The contact pieces 20 of the contacts 14 adapted to contact a card 60 to be inserted into the fitting opening 28 upper than the lowermost fitting opening 26 are bent such that the bent contact pieces 20 of the contacts 14 do not extend into the lower fitting opening 26. Moreover, the contacts 14 are inserted into the housing 12 from the side of the fitting opening and held in the housing.

As can be seen from the above description, the card connector according to the invention can bring about the following significant function and effect. According to the invention, the connector 10 into and from which a plurality of cards are inserted and removed, including a required number of contacts 14 each having a contact portion adapted to contact the card, and a housing 12 arranging and holding the contacts 14 and having one or plural fitting openings each into which the card is inserted, wherein the contacts 14 each comprise contact portions 22 and 24 to contact at least two cards 50 and 60 so that the same contact 14 can be brought into contact with at least two cards 50 and 60. Therefore, the card connector 10 according to the invention has a high degree of freedom for design of substrate and connector without complicating the arrangement of connection portions 16 of contacts 14 and without any limitation of areas occupied by substrates, and is easy to assemble and easy to mount connection portions onto a substrate by a customer or consumer.

According to the invention, the card connector 10 into and from which two cards 50 and 60 are inserted and removed one above the other, including a required number of contacts 14 each having a contact portion adapted to contact the card 50, 60, and a housing 12 arranging and holding the contacts 14 and having two fitting openings 26 and 28 into which the cards 50 and 60 are inserted, respectively, wherein the contacts 14 each comprise contact portions 22 and 24 to contact the two cards 50 and 60, respectively, so that the same contact 14 can be brought into contact with the two cards 50 and 60. Consequently, the card connector 10 according to the invention has a high degree of freedom for design of substrate and connector without complicating the arrangement of connection portions 16 of contacts 14 and without any limitation of areas occupied by substrates, and is easy to assemble and easy to mount connection portions onto a substrate by a customer or consumer.

According to the invention, the housing 12 includes an upper wall 30, a lower wall 32, two side walls 34 for connecting the upper and lower walls 30 and 32, and a rear wall 36, and these upper 30, lower 32, two side 34 and rear 36 walls form the one or plural fitting openings 26 and 28, and the two side walls 34 are each provided at the inside with guide means 38 for guiding the card to the contact portions 22 and 24 of the contacts when the card 50, 60 is inserted. Therefore, the cards 50 and 60 can be reliably conducted to the contact portions 22 and 24 of the contacts 14.

According to the invention, the contacts 14 each comprise a connection portion 16 at one end adapted to be connected to a substrate or the like, a holding portion 18 provided contiguously to the connection portion 16 for fixing the contact to the housing 12, and contact pieces 20 at the other end, which are formed by dividing the portion adjacent to and extending from the holding portion 18 toward the other end into a plurality of pieces each having a contact portion 22, 24 adapted to contact the corresponding card. Accordingly, it is possible to provide a card connector 10 which is able to be connected to a plurality of cards 50 and 60 by the use of the same contacts 14.

According to the invention, the contact pieces 20 of the contacts 14 adapted to contact a card 60 to be inserted into the fitting opening 28 upper than the lowermost fitting opening 26 are bent such that the bent contact pieces 20 of the contacts 14 do not extend into the lower fitting opening 26. Therefore, the same contacts 14 can be securely brought into contact with a plurality of cards 50 and 60 and there is no card to which the contacts could not be connected.

According to the invention, the contacts 14 are inserted into the housing 12 from the side of the fitting opening and held in the housing. Therefore, the contacts 14 having a plurality of contact pieces 20 can be easily inserted into the housing 12, and unintentional deformation of the contacts 14 is easy to confirm.

The invention will be more fully understood by referring to the following detailed specification and claims taken in connection with the appended drawings.

DESCRIPTION OF THE PREFERRED EMBODIMENTS

Figure 1A:
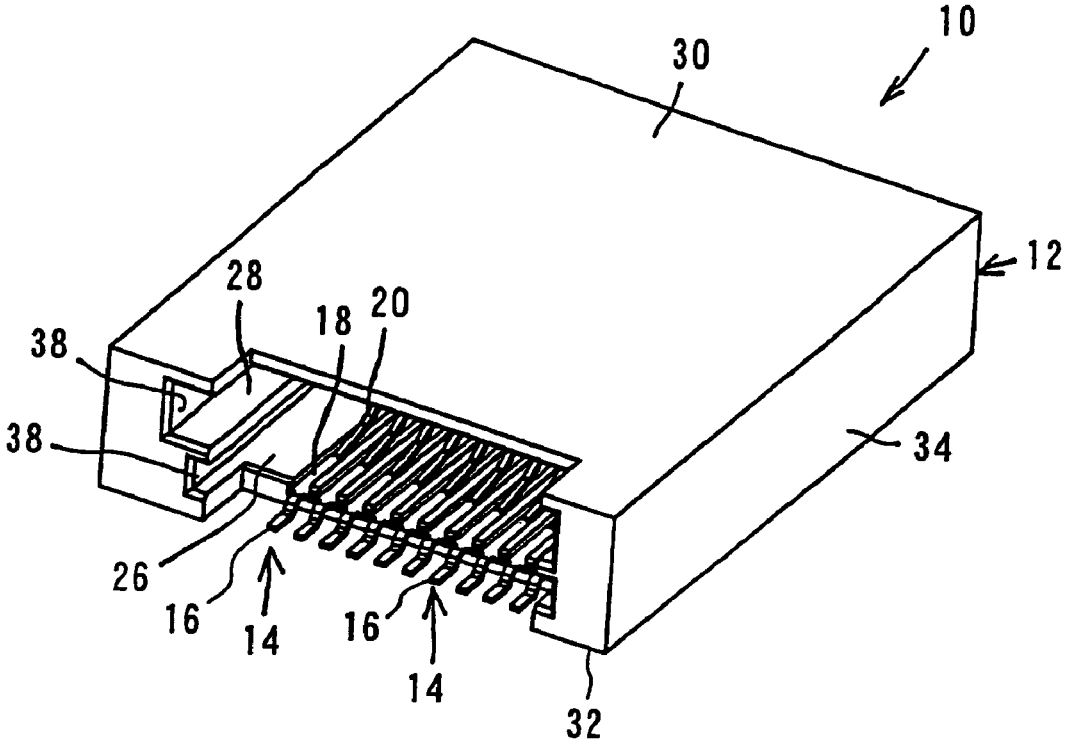
FIG. 1A is a perspective view of a card connector viewed from the above on the fitting opening side.
Figure 1B:
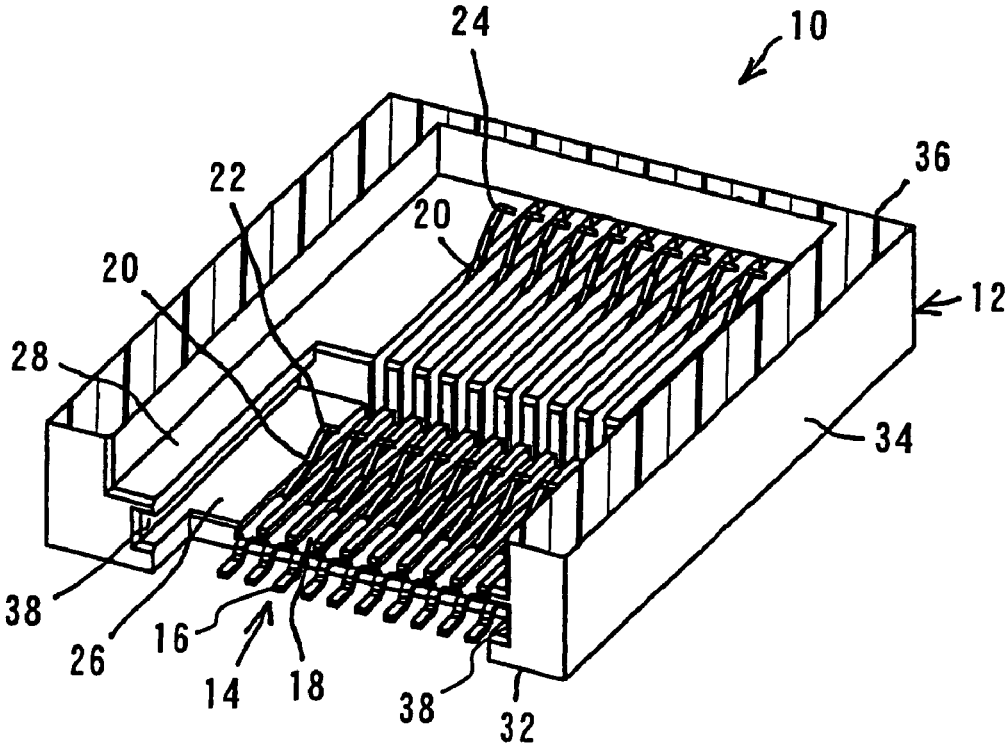
FIG. 1B is a perspective view of the card connector similar to that shown in FIG. 1A, with the upper wall of the housing removed.
Figure 2A:
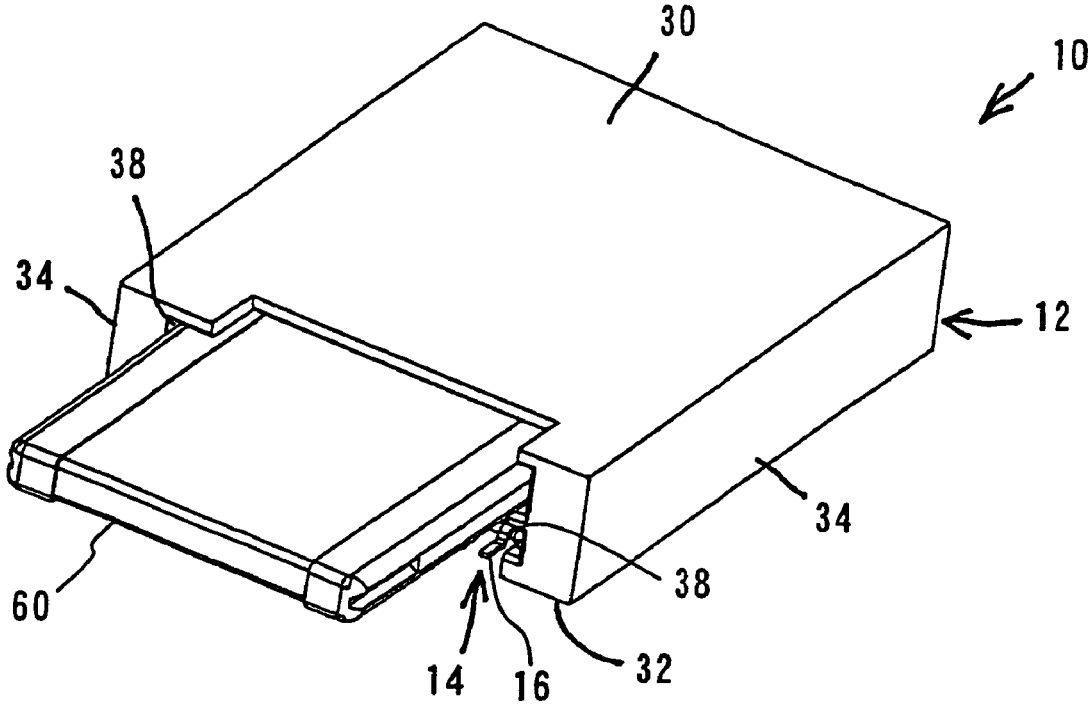
FIG. 2A is a perspective view of the card connector with a card inserted into the upper fitting opening.
Figure 2B:
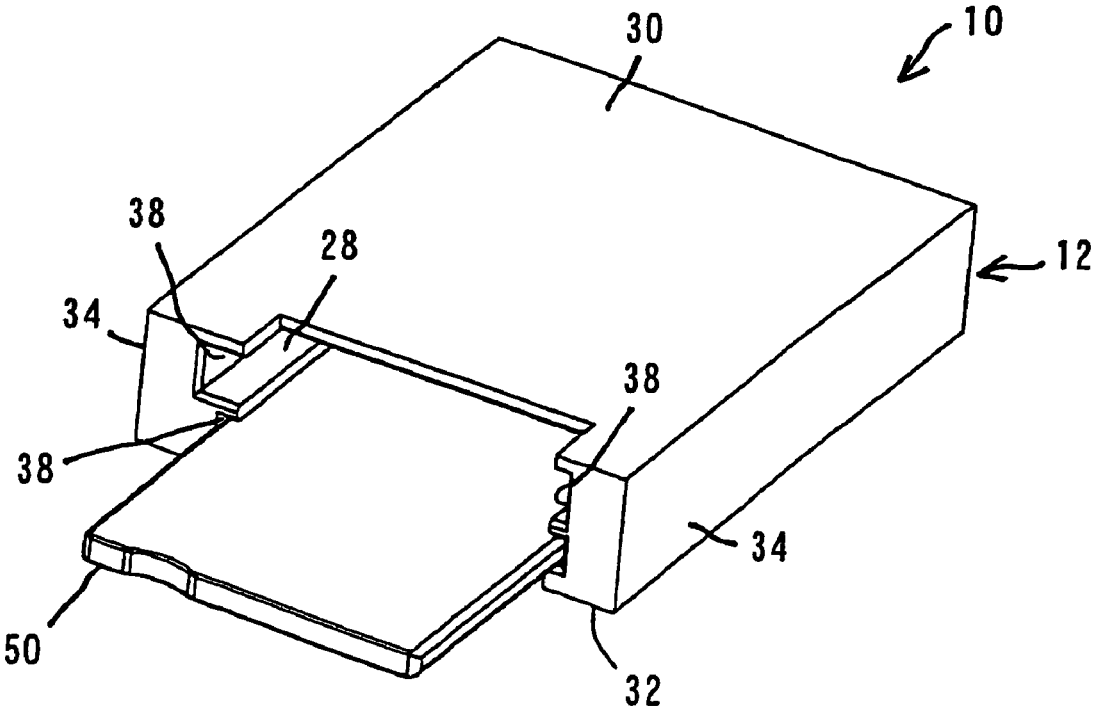
FIG. 2B is a perspective view of the card connector with a card inserted into the lower fitting opening.
Figure 3:
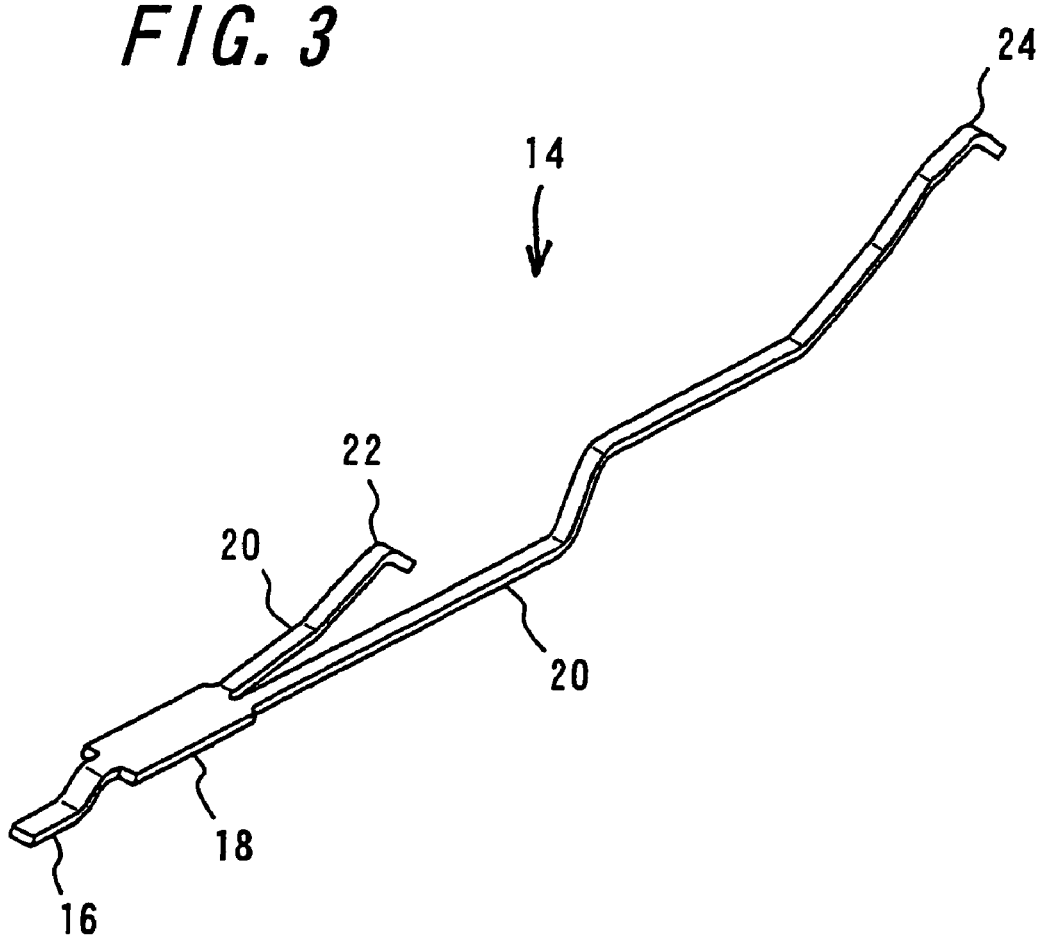
FIG. 3 is a perspective view of a contact used in the card connector.
Figure 4:
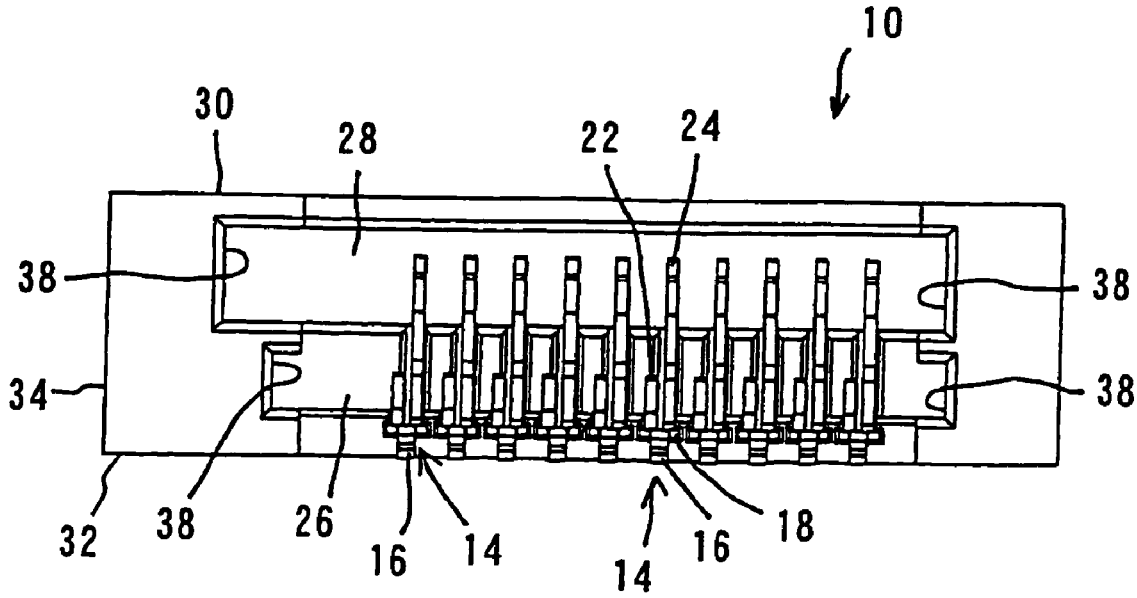
FIG. 4 is a front view of the card connector.

One embodiment of the invention will be explained with reference to FIGS. 1A to 4. FIG. 1A is a perspective view of the card connector viewed from above on the side of its fitting opening, while FIG. 1B is a perspective view of the card connector similar to that shown in FIG. 1 with the upper wall of its housing removed. FIG. 2A is a perspective view of the card connector with a card inserted in the upper fitting opening, while FIG. 2B is a perspective view of the card connector with a card inserted in the lower fitting opening. FIG. 3 is a perspective view of a contact used in the card connector according to the invention. FIG. 4 is a front elevation of the card connector.

The card connector 10 according to the invention mainly comprises contacts 14 and a housing 12.

Before explaining the components of the card connector, the cards will be explained. The cards are used for printers, card readers and the like. The cards each mainly comprise contact portions adapted to contact the contact portions 22 and 24 of the contacts 14, patterns connecting from the contact portions of the card to circuits, and connection portions adapted to be connected to integrated circuits and central processing units mounted on the patterns. Cards to be used for the card connector 10 according to the invention include MULTIMEDIA card, SD card (SECURE DIGITAL memory card), MEMORY-STICK, SMARTMEDIA, COMPACT-FLASH, XD card, MEMORY-STICK DUO, and the like, these being IC cards having built-in central processor unit (CPU) or integrated chips (ICs) used as memory devices for storing information.

With the card connector 10 in the illustrated embodiment, the Memory-Stick 60 is inserted into the upper fitting opening, and the Memory-Stick Duo 50 is inserted into the lower fitting opening.

First, the contact 14 will be explained which is a subject matter of the invention. The contacts 14 are made of a metal and formed by means of the press-working of the known technique. Preferred metals from which to form the contacts 14 include brass, beryllium copper, phosphor bronze and the like which comply with the requirements such as electric conductivity, springiness, workability, and the like.

The contact 14 comprises at least contact portions 22 and 24 adapted to contact the plurality of cards 50 and 60, respectively, a holding portion 18 to be fixed to the housing 12, and a connection portion 16 to be connected to a substrate.

An important aspect of the contact 14 according to the invention lies in the feature capable of contacting a plurality of cards. For example, the contact 14 can contact both the Memory-Stick 60 inserted in the upper fitting opening and the Memory-Stick Duo 50 inserted in the lower fitting opening of the card connector. While the contact can contact the two cards 50 and 60 as shown in FIG. 3, it will be apparent that it is possible to design the contact to be able to contact more than two cards.

While the connection portion 16 of the contact 14 is of a surface mounting type (SMT) in the illustrated embodiment, it may be of a dip type. The connection portion 16 of the contact 14 may be suitably designed according to a specification of the substrate to which the connection portion 16 is connected. In the illustrated embodiment, the connection portion 16 extends onto the side of the insertion of the cards 50 and 60 (on the side of the fitting openings 26 and 28 for the cards), although the connection portion 16 may extend onto the opposite side of the fitting openings. The extending direction of the connection portion may be suitably designed in consideration of the specification of the substrate, positions of the contact portions of the cards 50 and 60 and positions of insertion of the cards into the upper and lower fitting openings. It is preferable to insert and hold the contact 14 into the housing from the side of the fitting opening (from the side of the insertion of the cards) in view of easier insertion of the contact and easier ascertainment of deformation of the contact.

The holding portion 18 of the contact 14 serves to fix the contact 14 to the housing 12 by press-fitting arrow-head members into the housing 12, the arrow-head members being previously provided at the holding portion 18 to extend in width directions. Other than the press-fitting, it may be fixed to the housing 12 by hooking, welding, or the like. The size of the holding portion 18 may be suitably designed in consideration of the fact that the forwardly extending portion from the holding portion 18 is divided into a plurality of contact pieces 20 as described below, and the strength of the housing 12, miniaturization of the card connector 10 and the like. In the illustrated embodiment, the holding portion 18 is approximately 25 mm in width.

As described above, in order to bring the contact 14 (a single contact) into a plurality of cards (two cards in the illustrated embodiment), the forwardly extending portion from the holding portion 18 is divided into two contact pieces 20 extending in the longitudinal direction in the illustrated embodiment. The contact pieces 20 are each provided at its tip with a contact portion 22, 24 adapted to contact the respective card 50, 60. Positions of the contact portions 22 and 24 are suitably designed so that they extend into the respective fitting openings 26 and 28 to obtain predetermined contact pressures as shown in FIG. 1B, and further in consideration of positions of the contact portions of the cards 50 and 60 to be inserted and recognition of the cards to be inserted into the upper and lower fitting openings. As the Memory-Stick 60 is to be inserted into the upper fitting opening and the Memory-Stick Duo 50 is to be inserted into the lower fitting opening in the illustrated embodiment, the contact portion 24 to contact the Memory-Stick 60 in the upper fitting opening is longer and arranged at a higher position, and the contact portion 22 to contact the Memory-Stick Duo 50 in the lower fitting opening is shorter and arranged at a lower position. In order to locate the contact portion 24 for the Memory-Stick at the higher position to extend into the fitting opening 28 for the Memory-Stick, the contact piece 20 of the contact 14 is bent at its mid portion. The mid portion of the contact piece 20 at which it is bent is designed so as to avoid the bent portion of the contact piece 20 from extending into the lower fitting opening 26 for the Memory-Stick Duo 50. In other words, the contact piece 20 of the contact 14 adapted to contact the card 60 to be inserted into the upper fitting opening 28 is bent so as not to extend into the lower fitting opening 26 below the upper fitting opening 28. Widths of the contact pieces 20 are about one half of the width of the holding portion 18.

The housing 12 will then be explained. The housing 12 is formed from an electrically insulating plastic material by means of the injection molding of the known technique. The materials suitable for the housing 12 include polybutylene terephthalate (PBT), polyamide (66PA or 46PA), liquid crystal polymer (LCP), polycarbonate (PC) and the like and combination thereof in consideration of dimensional stability, workability, manufacturing cost and the like. The housing 12 may be provided with a required number of fitting openings into which a plurality of cards is inserted, respectively. The housing 12 is provided with two fitting openings 26 and 28 arranged one above the other in the illustrated embodiment. Sizes of the fitting openings 26 and 28 are suitably designed so that the cards 50 and 60 can be inserted into the fitting openings, respectively, and on insertion of the cards 50 and 60, they can be brought into contact with the contacts 14.

The housing 12 comprises at least an upper wall 30, a lower wall 32, two side walls 34 and a rear wall 36. A required number of intermediate walls may be provided depending upon the number of cards to be inserted, as the case may be. The upper wall 30, the lower wall 32, the two side walls 34 and the rear wall 36 form the upper fitting opening 28 for the Memory-Stick 60 and the lower fitting opening 26 for the Memory-Stick Duo 50.

The side walls 34 are each provided on the inside with guides 38 for the purpose of facilitating conducting the inserted cards to the respective contact portions 22 and 24 of the contacts. Sizes of the guides 38 may be determined to enable the cards 50 and 60 to be guided to the respective contact portions 22 and 24 of the contacts and may be suitably designed in consideration of the sizes of the cards 50 and 60 and the strength of the housing 12.

Although the card connector having two fitting openings for the cards 50 and 60 arranged one above the other is shown in the illustrated embodiment, it is to be understood that a card connector may be constructed to bring a plurality of cards into contact with the same contacts irrespective of the number of cards.

Examples of applications of the present invention are card connectors 10 for use in electric and electronic appliances in instruments and for use in printers and card readers and particularly card connectors capable of accommodating a plurality of cards with the same contacts 14.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A card connector into and from which two differently configured cards inserted in fitting openings arranged at different heights can be inserted and removed, said card connector comprising a required number of contacts, each having a contact portion configured to contact each card, and a housing arranging and holding said contacts and having two adjacent fitting openings into which said cards are inserted, respectively, wherein said contacts each comprise contact portions to contact the two cards, respectively, so that each contact is brought into contact with the two cards inserted in the fitting openings at different heights; and said contacts each comprise a connection portion formed at one end configured to be connected to a substrate, a holding portion having a first end contiguous with said connection portion for fixing said contact to said housing, and at least two contact pieces formed at an opposing end of said holding portion, said contact pieces extending different lengths and heights with respect to each other from said holding portion, wherein each contact piece includes an end formed by one of said contact portions; and wherein said holding portion and said connection portion at the first end thereof, said at least two contact pieces formed at the opposing end of said holding portion, and said contact portions collectively extend substantially linearly to form said substantially elongated shaped contact.

2. The card connector as set forth in claim 1, wherein said housing includes an upper wall, a lower wall, two side walls for connecting said upper and lower walls, and a rear wall, said upper, lower, two side and rear walls forming said one or plural fitting openings, and wherein said two side walls include guide means for guiding each card to an associated contact portion of said contacts when the card is inserted.

3. The card connector as set forth in claim 2, wherein said contacts are inserted into said housing from one of the side walls forming said fitting opening and held in the housing.

4. The card connector as set forth in claim 2, wherein each contact portion associated with each contact piece is positioned to contact a card to be inserted into an associated fitting opening.

5. A card connector adapted for insertion and removal of a plurality of different types of cards, said card connector including a required number of contacts configured to contact said plurality of different types of cards; and a housing for arranging and holding said contacts, and having a plurality of fitting openings arranged at different heights, each fitting opening being dimensioned for insertion and removal of one of said plurality of cards, wherein one of said cards that is inserted in a corresponding fitting opening is at a different height than another of said cards;

wherein said contacts are substantially elongated in shape and extend along a longitudinal axis in a direction of insertion and removal of said cards into said housing, and each contact comprises at least two contact portions, each contact portion being positioned to contact one of said at least two different types of cards so that the same contact is brought into contact with said at least two different types of cards when inserted in said fitting openings positioned at different heights; and each contact further including a connection portion formed at one end that is configured to be connected to a substrate, a holding portion having a first end provided contiguously to said connection portion for fixing said contact to said housing, and at least two contact pieces formed at an opposing end of said holding portion, said contact pieces being positioned substantially adjacent to each other and each contact piece extends a different length and height with respect to each other from said holding portion, and wherein each contact piece terminates with one of said contact portions; and wherein said holding portion and said connection portion at the first end thereof, said at least two contact pieces formed at the opposing end of said holding portion, and said contact portions collectively extend substantially linearly along the longitudinal axis to form said substantially elongated shaped contact.

6. The card connector as set forth in claim 5, wherein said housing includes an upper wall, a lower wall, two side walls for connecting said upper and lower walls, and a rear wall, said upper, lower, two side and rear walls forming said one or plural fitting openings, and wherein said two side walls include guide means for guiding each card to an associated contact portion of said contacts when the card is inserted.

7. The card connector as set forth in claim 6, wherein said contacts are inserted into said housing from one of the side walls forming said fitting opening and held in the housing.

8. The card connector as set forth in claim 5, wherein each contact portion associated with each contact piece is positioned to contact a card to be inserted into an associated fitting opening.

9. The card connector as set forth in claim 1, wherein said holding portion and said connection portion at the first end thereof, said at least two contact pieces formed at the opposing end of said holding portion, and said contact portions each form an angle of not greater than ninety degrees with respect to said longitudinal axis.

10. A card connector configured for removably receiving a plurality of different sized cards, each card having a plurality of electrical contacts, comprising:

a housing having at least two adjacent fitting openings, each fitting opening sized to receive one of said plurality of different sized cards, and said fitting openings being arranged at different heights in said housing;

a plurality of substantially elongated contacts, where each contact includes a holding portion configured for arranging and securing said contact to said housing, a connection portion formed contiguously with a first end of said holding portion and extending from said housing, a plurality of contact pieces formed contiguous with an opposing second end of said holding portion and terminating with a contact portion, each said contact piece extending a different length and height with respect to another contact piece from said second end of the holding portion, and wherein each contact portion is associated with one of said fining openings, and wherein said holding portion and said connection portion at the first end thereof, said at least two contact pieces formed at the opposing end of said holding portion, and said contact portions collectively extend substantially linearly in a direction of insertion and removal of said cards.

11. (Previously presented The card connector as set forth in claim 10, wherein said housing includes an upper wall, a lower wall, two side walls for connecting said upper and lower walls, and a rear wall, said upper, lower, two side and rear walls forming said fining openings, and wherein said two side walls form guide means for guiding each card into one of said fitting openings and contacting corresponding contact portions of said contacts during insertion of the card.

12. The card connector as set forth in claim 10, wherein said connection portion of said contacts are connected to an electrical circuit.

13. The card connector as set forth in claim 10, wherein each contact portion associated with each contact piece of said contact comprises a metallic resilient member.

14. The card connector as set forth in claim 10, wherein each contact portion is positioned to provide electrical connectivity with one of the plurality of electrical contacts of the different sized cards.

15. The card connector as set forth in claim 10, wherein the fitting openings are formed in a single side wall of said housing.

* * * * *